US006868773B2

(12) United States Patent
Davis et al.

(10) Patent No.: US 6,868,773 B2
(45) Date of Patent: Mar. 22, 2005

(54) FLUIDIC ACTUATOR

(75) Inventors: Donald L. Davis, Roscoe, IL (US); Jeffrey A. Carlson, Roscoe, IL (US)

(73) Assignee: Electro Cam Corporation, Roscoe, IL (US)

( * ) Notice: Subject to any disclaimer, the term of this patent is extended or adjusted under 35 U.S.C. 154(b) by 0 days.

(21) Appl. No.: 10/638,109

(22) Filed: Aug. 8, 2003

(65) Prior Publication Data

US 2004/0107829 A1 Jun. 10, 2004

Related U.S. Application Data

(60) Provisional application No. 60/403,137, filed on Aug. 13, 2002.

(51) Int. Cl.[7] ..... F01B 19/04
(52) U.S. Cl. ..... 92/92; 92/153
(58) Field of Search ..... 92/89, 90, 91, 92/92, 153

(56) References Cited

U.S. PATENT DOCUMENTS

| | | | | |
|---|---|---|---|---|
| 3,830,519 A | | 8/1974 | Lewis | |
| 3,864,983 A | | 2/1975 | Jacobsen | |
| 3,882,551 A | | 5/1975 | Helmer et al. | |
| 4,733,603 A | * | 3/1988 | Kukolj | 92/92 |
| 4,739,692 A | | 4/1988 | Wassam et al. | |
| 4,751,869 A | | 6/1988 | Paynter | |
| 4,819,547 A | | 4/1989 | Kukolj | |
| 4,841,845 A | | 6/1989 | Beullens | |
| 5,014,600 A | | 5/1991 | Krauter et al. | |
| 5,021,064 A | | 6/1991 | Caines | |
| 5,031,510 A | * | 7/1991 | Krauter | 92/92 |
| 5,052,273 A | | 10/1991 | Sakaguchi | |
| 5,090,297 A | * | 2/1992 | Paynter | 92/92 |
| 5,185,932 A | | 2/1993 | Caines | |
| 5,351,602 A | | 10/1994 | Monroe | |
| 5,937,732 A | | 8/1999 | Homann | |
| 6,067,892 A | | 5/2000 | Erickson | |
| 6,223,648 B1 | | 5/2001 | Erickson | |
| 6,349,746 B1 | | 2/2002 | Bergemann et al. | |

OTHER PUBLICATIONS

Festo New Fluidic Muscle Type MAS brochure by Festo Corporation, Products 2001, 06/01.
Roy O'Connor, "Pistonless Actuator Speeds Paper Punch," Design News, Mar. 26, 2001, p. 70.
Festo Fluidic Muscle MAS, MAS–New–Product–Folder–Two, 2001.
Glenn K. Klute, et al., "Fatigue Characteristics of McKibben Artificial Muscle Actuators," Proceedings, IROS–98, Victoria, B.C., Canada, Nov. 1998, pp. 1776–1782.
Vertigo, Inc. web page entitled Pneumatic Muscle Soft Landing Actuator, printed Mar. 21, 2003.

* cited by examiner

*Primary Examiner*—F. Daniel Lopez
*Assistant Examiner*—Michael Leslie
(74) *Attorney, Agent, or Firm*—Foley & Lardner LLP

(57) ABSTRACT

A fluidic actuator includes a central elastic tube with an interior bore and a surrounding sheath formed of braided fibers. End fittings are attached to the tube and sheath at first and second ends thereof and include a cap with a hollow cavity into which an end section of the tube and sheath are inserted and embedded in a hardened adhesive. The hardened adhesive seals off the ends of the tube and strongly bonds the fibers of the sheath to the end caps to provide strong mechanical connections. A fluid coupling may extend through one of the end caps to connection to an end of the tube, with an interior bore in the coupling in communication with the bore in the tube to allow fluid under pressure to be supplied to the interior of the tube. A liquid lubricant may be held in the fibers of the sheath to provide lubrication between the elastic tube and the fibers of the sheath to reduce wear and abrasion of the tube and extend the service life of the actuator.

13 Claims, 3 Drawing Sheets

FLUIDIC ACTUATOR

CROSS REFERENCE TO RELATED APPLICATION

This application claims the benefit of provisional application No. 60/403,137, filed Aug. 13, 2002, the disclosure of which is incorporated herein by reference.

FIELD OF THE INVENTION

This invention pertains generally to the field of pneumatic and hydraulic actuators and particularly to contractile actuators, sometimes referred to as artificial muscle.

BACKGROUND OF THE INVENTION

Various types of fluidic actuators are utilized for converting pressurized fluids such as air or hydraulic fluid to mechanical motion. These actuators include the common piston-cylinder drive in which a piston slides within the chamber of a cylinder and is driven by a differential in fluid pressure across the piston, as in the very common commercially available air cylinder drives and hydraulic rams. Such actuators can have a relatively long stroke but are limited in applied force to the fluid pressure across the piston times the surface area of the piston. Another type of fluidic actuator simulates the action of natural muscle contraction. An elastic tube or bladder is surrounded by a sleeve or sheath of relatively inelastic material, typically braided fibers, and the two ends of the sheath and the central tube can be connected by end fittings to other mechanical structures. When a fluid under pressure, such as air or hydraulic fluid, is introduced into the inner bladder, it expands along its length, forcing the fibers of the surrounding sheath outwardly, drawing the two ends of the actuator closer together and exerting a force on the structures to which the actuator is attached. Because the inner tube or bladder is inflated outwardly along essentially its entire length, the cumulative outward force exerted on the surrounding sheath can be very great, so that very large forces can be applied by the actuator over a relatively small range of travel. Examples of such fluidic actuators are shown in U.S. Pat. Nos. 3,830,519, 4,739,692, 4,751,869, 4,819,547, 4,841,845, 5,014,600, 5,021,064, 5,052,273, 5,185,932, and 5,351,602.

While the forgoing contractile fluidic actuators are well-suited to applications requiring high forces applied over short distances because of their compactness and potential relatively low cost, such actuators have been subject to certain practical problems that have limited their use. One problem stems from the fact that the relatively soft and flexible inner bladder or tube is brought repeatedly into and out of contact with the harder and less resilient fibers of the outer sheath. Over many contraction cycles, the repeated contact between the elastic bladder and the sheath can abrade the material of the bladder, eventually leading to leaks in the bladder and complete failure of the actuator after a relatively short service life. Another difficulty encountered in practice relates to the fittings that are connected to the ends of the sheath. The mechanical connection between the fibers of the sheath and the fittings must withstand the full force applied by the actuator and must be capable of doing so over many contraction cycles. Typically, a fluid coupling is also incorporated into one of the end fittings so that the fluid can be introduced at one end of the actuator rather than at some intermediate position. This fluid coupling fitting must be securely connected to the tube so that the tube will not disengage from the fitting during use, and preferably, it is also connected to the outer sheath to form part of the structural connecting fitting. Conventional crimp type collars have been used to hold the sheath on the fittings, but these may not perform satisfactorily to hold the sheath and fitting together over an extended number of contraction cycles. To use a sufficiently strong and robust connector between the sheath and fitting can significantly increase the total cost of the actuator and add to its bulk.

SUMMARY OF THE INVENTION

A fluidic actuator in accordance with the present invention incorporates strong, simple end fittings having relatively low cost but long service life. The fluidic actuator in accordance with the invention may also be formed to have low friction and low abrasion and provide long service life over many cycles.

The fluidic actuator in accordance with the invention includes an elastic tube with first and second ends and a central bore, and a flexible sheath surrounding the tube. The tube may be either thin-walled or thick-walled. The sheath is formed of braided fibers of a strong structural material such as nylon, polypropylene, etc. End fittings are connected to the two ends of the tube and sheath. The end fittings each preferably include a cap having a central, hollow body, preferably cylindrical, which is open on one end and closed at the other end by a top plate. A hardened adhesive, preferably epoxy, fills the open cavity of the cap with a portion of the elastic tube and the sheath embedded in the hardened adhesive. The hardened adhesive forms a strong bond between the cap, the sheath, and the tube that is capable of withstanding the forces imposed on the sheath during normal operation and transmitting those forces to the cap. A fluid coupling may be mounted at one end of the actuator to provide fluid coupling communication to the interior bore of the tube. The fluid coupling preferably is mounted to the cap and has a portion thereof within the interior cavity of the cap which is also embedded in and tightly bonded by the hardened adhesive. In this manner, a strong, simple, and inexpensive fluid supply connection can be made to the interior of the tube at the natural opening of the tube at its end to ensure maximum structural integrity to the tube.

It has been found in accordance with the invention that the functional life of a contractile fluidic actuator having a central elastic tube and surrounding sheath can be greatly enhanced by utilizing a liquid lubricant between the tube and the sheath and which is preferably absorbed in and held in the sheath. The braided fibers of the sheath are well-suited to hold suitable lubricants by wicking action so that lubricant is retained in the actuator for long periods of time. Particularly preferred materials that provide low friction and low abrasion over time include polypropylene fibers forming the braided sheath and a glycerin lubricant, although it is understood that other structural fibers and lubricants may also be utilized as appropriate. Utilization of appropriate lubricants and low friction sheath materials is found to greatly enhance the service life of the fluidic actuator and can effectively eliminate the abrasion conventionally encountered in actuators of this type.

Further objects, features and advantages of the invention will be apparent from the following detailed description when taken in conjunction with the accompanying drawings.

DETAILED DESCRIPTION OF THE INVENTION

Figure 1:
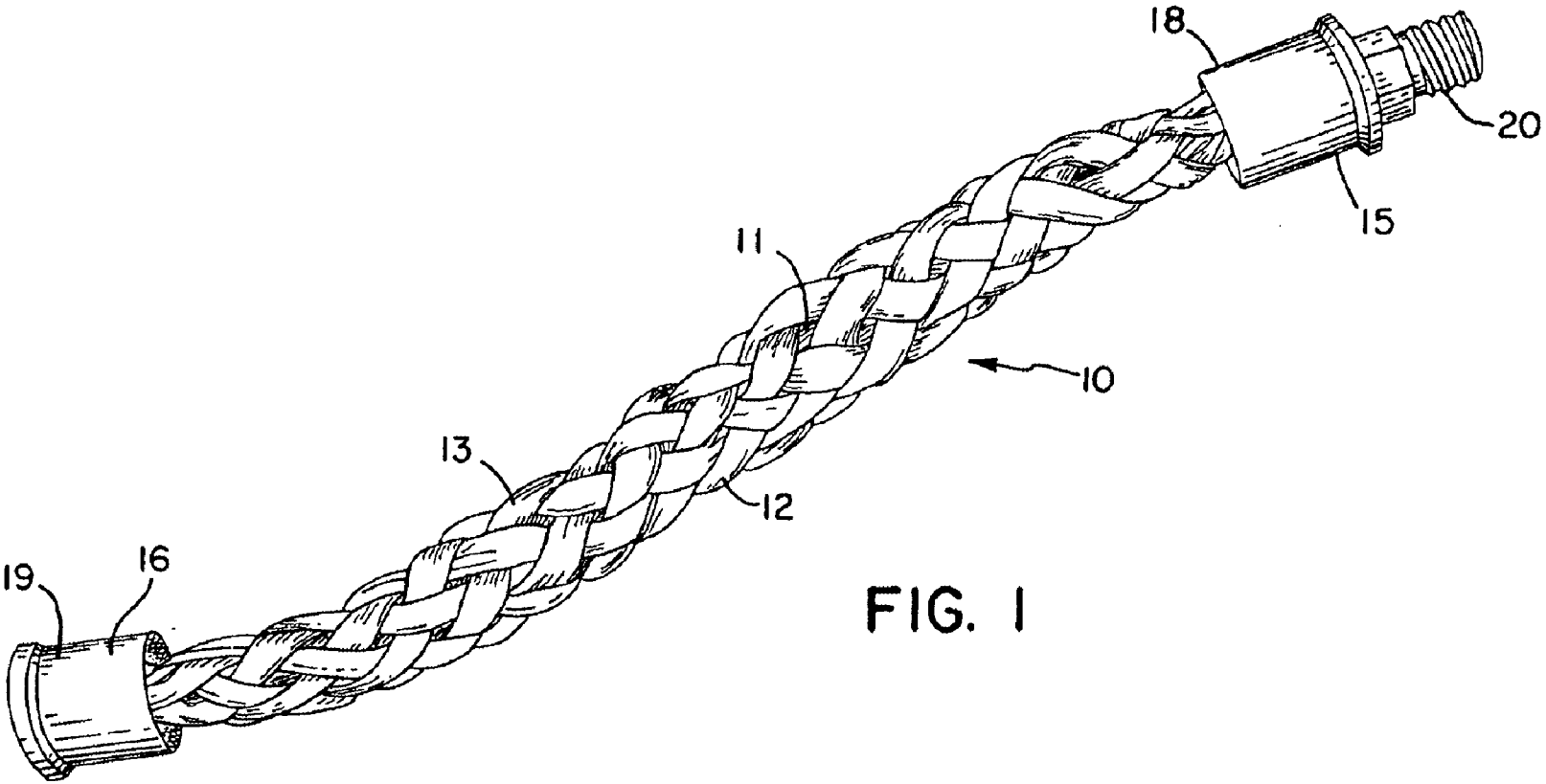
FIG. 1 is a perspective view of a fluidic actuator in accordance with the invention shown in its relaxed or uninflated form.
Figure 2:
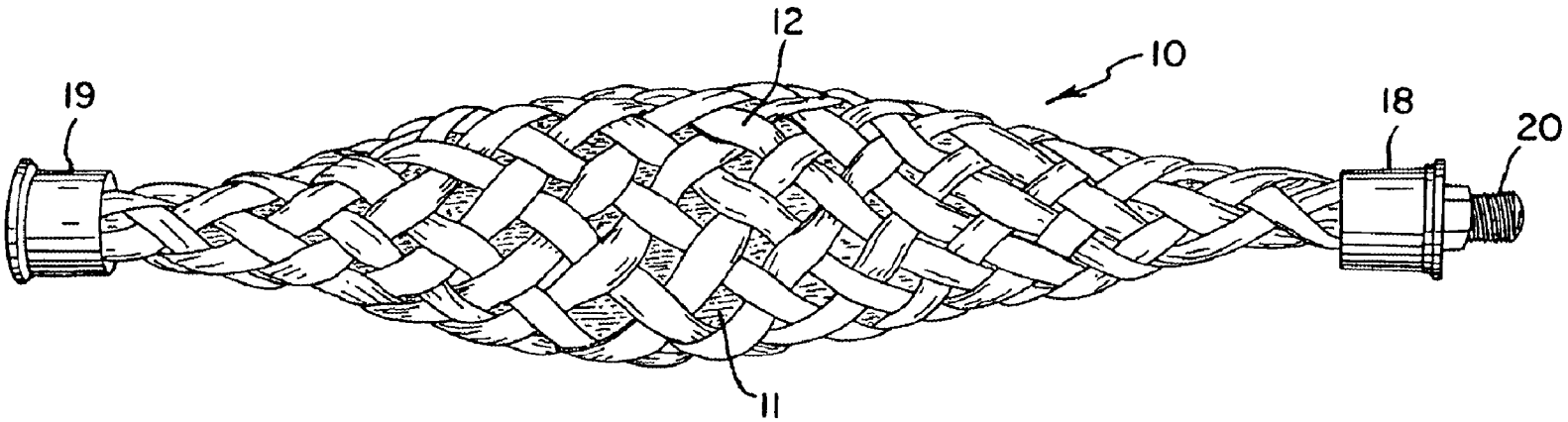
FIG. 2 is a perspective view of the actuator of FIG. 1 shown in its charged or contracted configuration.

With reference to the drawings, a fluidic actuator in accordance with the invention is shown generally at 10 in FIG. 1 in its uncontracted or relaxed configuration. The actuator 10 has an elastic tube 11 (e.g., surgical tubing) which is surrounded by a sheath 12 formed of braided fibers 13. A thin-walled tube may be preferred for some purposes, and relatively thick walled tubes (e.g., ½ inch inside diameter/1½ inch outside diameter) of elastics such as gum rubber may be preferable for other applications. The central tube is largely obscured in FIG. 1 by the outer sheath 12 and is more clearly illustrated in the cross-sectional views of FIGS. 3 and 4 taken at a first end 15 and a second end 16, respectively, of the actuator. End fittings 18 and 19 are attached to the ends of the tube 11 and the sheath 12 at the first end and second end, respectively, in a manner as discussed further below. The fitting 18 at the first end 15 includes a fluid coupling 20 by which a fluid supply line, e.g., a line supplying air under pressure, can be connected to supply fluid under pressure to the interior bore 21 of the tube 11, as best shown in the cross-sectional view of FIG. 3. The fitting 19 at the second end preferably closes and seals off the interior bore of the tube at the second end 16, although a fluid coupling may also be utilized at the second end fitting 19 as desired. As illustrated in FIG. 2, when fluid is supplied under pressure through the coupling 20, the elastic tube 11 inflates outwardly along its length, driving the fibers of the sheath 12 outwardly and exerting a contraction force between the end fittings 18 and 19 that can be applied to the mechanical structures to which the fittings 18 and 19 may be connected.

Figure 4:
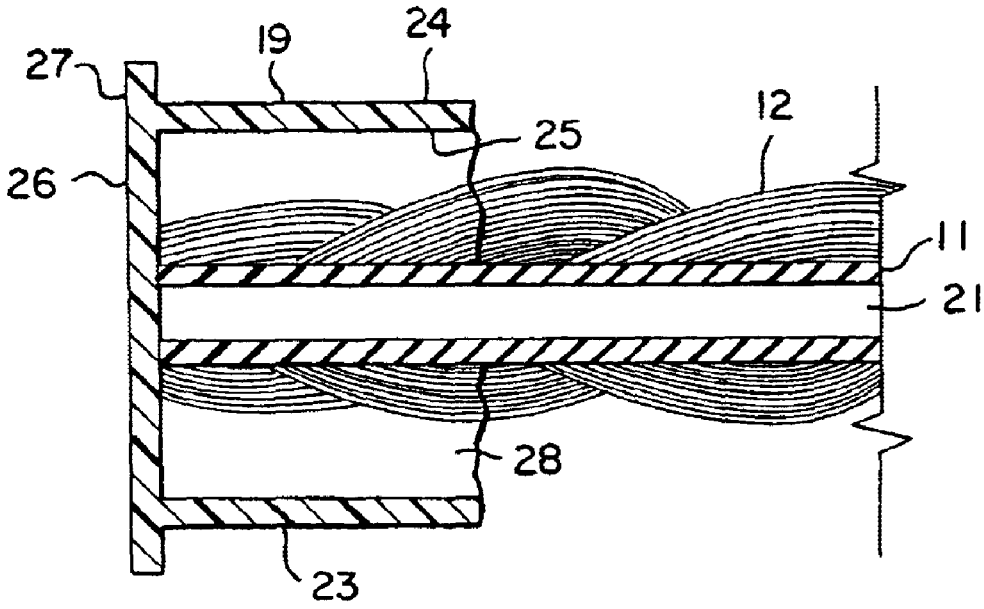
FIG. 4 is a cross-sectional view of the second end fitting of the actuator of FIG. 1.

As is best illustrated in the cross-sectional view of FIG. 4, the second end fitting 19 is formed of a unitary cap 23 having a cylindrical body 24 with a hollow cylindrical interior cavity 25 that is closed at one end by an end plate 26. A flange 27 extends outwardly from the remainder of the cylindrical body 24 to provide a connection by which force applied to the cap 23 can be transmitted to other mechanical structures. It is understood that the flange 27 may be formed at other positions on the cap 23 rather than at the end plate 26, and that other connection structures may be utilized. For example, the cap 23 may have a lug formed on it by which the cap can be bolted to a surrounding structure, or the cap 23 may be formed with external threads on the surface of the cylindrical body 24 so that a connector can be threaded onto it. A portion of the tube 11 and the sheath 12 extend into the cavity 25 of the cap, preferably with the open end of the tube 11 extending to or near the end plate 26. The interior of the cavity 25 of the end cap is filled with a hardened adhesive, preferably epoxy, in which portions of the sheath 12 and the tube 11 are embedded. The assembly of the end cap 23 to the end of the tube 11 and to the end of the sheath 12 is easily and simply accomplished by inserting the tube and sheath into the cavity 26, filling the cavity with the liquid adhesive, and then hardening the adhesive to form a strong bond between the cap 26 and the sheath 12 and to close off and seal off the interior bore 21 of the tube 11 at the end of the tube. Epoxy is particularly preferred as the adhesive because it will tightly bond to synthetic polymer fibers such as polypropylene and to the elastic material of the tube 11. An example of suitable epoxy adhesive is standard two part industrial epoxy (e.g., 15852 SY-FF epoxy from Pacer Technologies—Super Glue Corporation). The end cap 23 may be made of various materials, including plastics and metals. For example, the end cap 23 may be conveniently molded of a plastic such as polypropylene, to which epoxy will bond very strongly.

Figure 3:
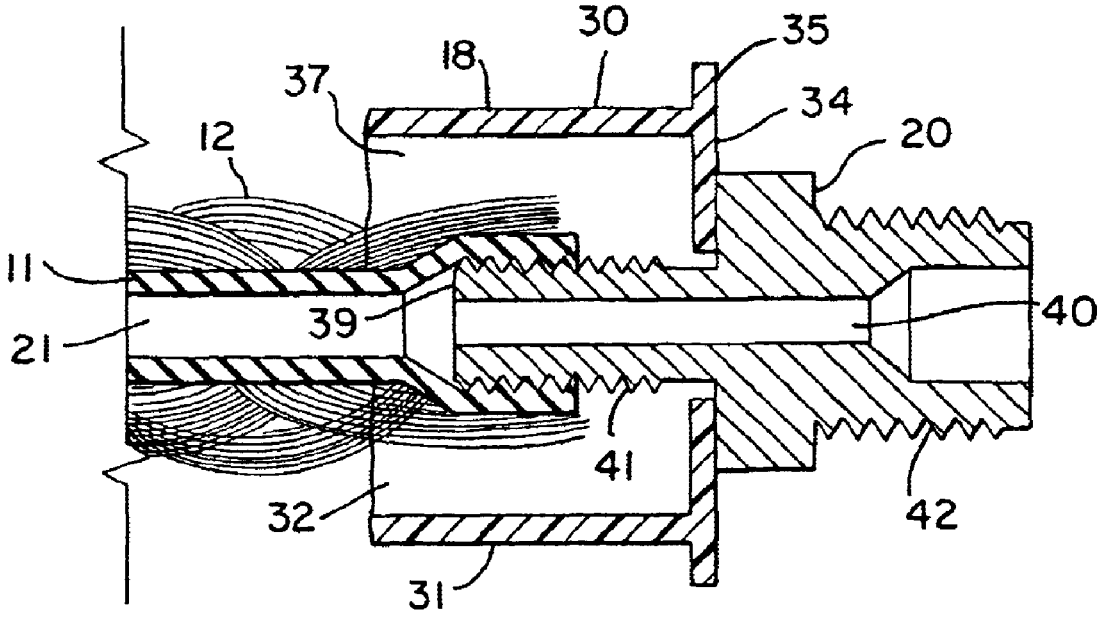
FIG. 3 is a cross-sectional view of the end fitting with fluid coupling of the actuator of FIG. 1.

The first end fitting 18 may be formed in a similar manner, having an end cap 30 with a cylindrical body 31 having an interior cavity 32 which is closed off on one end by an end plate 34, and with a flange 35 extending outwardly from the body 18 for connection to other mechanical structures. A hardened adhesive 37, such as epoxy, fills the cavity 32 to bond and embed a portion of the sheath 12 and tube 11 at their ends. As illustrated in FIG. 3, the fluid coupling 20 may have a tubular section 39 that extends through an opening in the end plate 34 of the cap 32 with a portion of the elastic tube 11 pulled up over the tube section 39 so that an interior bore 40 of the coupling 20 is in fluid communication with the interior bore 21 of the tube 11. The hardened adhesive 37 also surrounds and bonds to the exposed portions of the tubular section 39 so that the fluid coupling 20 is strongly and tightly attached to the cap 30 to provide a strong unitary fitting. The tubular section 39 may have external threads 41 which aid in firmly connecting the tubular section 39 to the tube 11 and which engage with the hardened adhesive 37 to provide a strengthened mechanical connection between the adhesive 37 and the fluid coupling 20. An outwardly extending section 42 of the coupling 20 may have threads formed thereon to allow a fluid supply line to be connected thereto by a threaded connector.

The sheath 12 is preferably formed, as illustrated in the figures, of multiple braids of a strong structural fibers, examples of which, for illustration only, include fiberglass, carbon, and various polymer fibers such as nylon, aramid polypropylene, etc. Polypropylene is a particularly advantageous fiber material for forming the sheath because it is relatively strong, inexpensive, readily bonded with appropriate adhesives and has relatively low friction both with itself and with the tube 11. It is also found, in accordance with the invention, that friction and abrasion between the fibers of the sheath 12 and the tube 11 can be greatly reduced by utilizing a lubricant between the sheath and the tube. In particular, glycerin is found to be a particularly effective lubricant for use with polypropylene fibers and will be held by wicking action in the fibers for relatively long periods of time. The lubricant may be added to the sheath by simply immersing the actuator in the lubricant so that it is absorbed into the sheath. Utilization of lubricants in this manner is found to greatly extend the life of the actuator by effectively eliminating abrasion of the relatively soft elastic tube 11 by the fibers of the sheath 12. If desired, a cover or outer sheath (not shown) may be placed around the sheath 12 to hold the lubricant in the sheath and protect the lubricant from airborne contaminants, and to inhibit evaporation of lubricants that are subject to evaporation in air.

It is understood that the invention is not confined to the particular embodiments shown herein for illustration and includes all forms thereof as come within the scope of the following claims.

What is claimed is:

1. A fluidic actuator comprising:

(a) an elastic tube having first and second ends and a central bore;

(b) a flexible sheath surrounding the tube, the sheath formed of fibers; and (c) end fittings connected to the first and second ends of the tube and to the flexible sheath at the first and second ends of the tube, the end fittings including an end cap having a hollow body closed by an end plate to define a cavity, a section of the tube and the flexible sheath at the ends thereof in the cavity embedded in and bonded to a hardened adhesive filling the cavity.

2. The fluidic actuator of claim 1 wherein one of the fittings at the ends of the actuator includes a fluid coupling extending through the end cap to connection to the elastic tube and having an interior bore thereof in communication with the bore of the elastic tube with a portion of the fluid coupling embedded in and bonded to the hardened adhesive.

3. The fluidic actuator of claim 2 including a threaded outer surface on the portion of the fluid coupling embedded in and bonded to the hardened adhesive.

4. The fluidic actuator of claim 1 wherein the hardened adhesive is epoxy.

5. The fluidic actuator of claim 1 wherein the end caps have outwardly extending flanges by which the end caps may be connected to other structures to apply force thereto.

6. The fluidic actuator of claim 1 wherein the sheath is formed of braided polypropylene fibers.

7. The fluidic actuator of claim 1 further including a liquid lubricant held in the fibers of the sheath and between the sheath and the tube.

8. The fluidic actuator of claim 7 wherein the lubricant is glycerin.

9. The fluidic actuator of claim 2 wherein the fluid coupling has a threaded outer surface that extends outwardly from the end plate of the cap by which the fluid coupling may be threadingly attached to a supply line.

10. A fluidic actuator comprising:

(a) an elastic tube having first and second ends and a central bore;

(b) a flexible sheath surrounding the tube, the sheath formed of fibers;

(c) end fittings connected to the first and second ends of the tube and to the flexible sheath at the first and second ends of the tube; and (d) a liquid lubricant held in the fibers of the sheath and between the sheath and the tube.

11. The fluidic actuator of claim 10 wherein one of the fittings at the ends of the actuator includes a fluid coupling extending to connection to the elastic tube and having an interior bore thereof in communication with the bore of the elastic tube.

12. The fluidic actuator of claim 10 wherein the sheath is formed of braided polypropylene fibers.

13. The fluidic actuator of claim 10 wherein the lubricant is glycerin.

* * * * *